US008412519B2

(12) United States Patent
Geiser et al.

(10) Patent No.: US 8,412,519 B2
(45) Date of Patent: Apr. 2, 2013

(54) STEGANOGRAPHY IN DIGITAL SIGNAL ENCODERS

(75) Inventors: Bernd Geiser, Aachen (DE); Peter Vary, Aachen (DE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 952 days.

(21) Appl. No.: 12/441,209

(22) PCT Filed: Aug. 29, 2007

(86) PCT No.: PCT/EP2007/007548
§ 371 (c)(1),
(2), (4) Date: Jun. 24, 2009

(87) PCT Pub. No.: WO2008/031498
PCT Pub. Date: Mar. 20, 2008

(65) Prior Publication Data

US 2011/0131047 A1 Jun. 2, 2011

(30) Foreign Application Priority Data

Sep. 15, 2006 (DE) ..... 10 2006 044 181
Feb. 16, 2007 (DE) ..... 10 2007 007 627

(51) Int. Cl.
*G10L 19/00* (2006.01)
*G10L 19/12* (2006.01)

(52) U.S. Cl. ..... 704/219; 704/221

(58) Field of Classification Search ..... None
See application file for complete search history.

(56) References Cited

U.S. PATENT DOCUMENTS 5,636,292 A * 6/1997 Rhoads ..... 382/232
6,493,457 B1 * 12/2002 Quackenbush et al. ..... 382/100
6,567,780 B2 * 5/2003 Rhoads ..... 704/273

(Continued)

FOREIGN PATENT DOCUMENTS

EP 1020848 A2 * 7/2000
EP 1 049 259 11/2000
JP 11 272299 10/1999

OTHER PUBLICATIONS

B. Geiser, P. Jax, and P. Vary, "Artificial bandwidth extension of speech supported by watermark transmitted side information," in Proc. of European Conf. on Speech Communication and Technology (INTERSPEECH), Lisbon, Portugal, Sep. 2005, pp. 1497-1500.*

(Continued)

*Primary Examiner* — Brian Albertalli

(57) ABSTRACT

In a method for embedding steganographic information into the signal information of a signal encoder, a solution is to be created, which enables steganographic information being embedded into the signal information of a signal encoder such that a reduction of the voice quality is largely avoided. This is achieved by means of providing data information, particularly voice information, selecting steganographic information from a quantity of steganographic information, generating a code word from a code book provided by means of the signal encoder on the basis of the code elements forming the code book such that with the use of the code word generated within the scope of a transmission standard associated with the code book the data information is encoded into signal information containing the code word and/or making reference to the code word; and by the code word generated having an additional feature that can be calculated on the basis of the code elements forming the code word, wherein the additional feature represents the steganographic information.

18 Claims, 5 Drawing Sheets

U.S. PATENT DOCUMENTS

| | | | | |
|---|---|---|---|---|
| 2003/0161469 | A1* | 8/2003 | Cheng et al. | 380/217 |
| 2004/0032967 | A1 | 2/2004 | Kim et al. | |
| 2004/0225500 | A1* | 11/2004 | Gardner et al. | 704/258 |
| 2007/0061577 | A1* | 3/2007 | Van De Kerkhof et al. | 713/176 |
| 2011/0208514 | A1* | 8/2011 | Tsuchinaga et al. | 704/201 |

OTHER PUBLICATIONS

Xiao Jianming; Li Xun; Wan Lei; Wu Xiaomei; Kuang Jingming; , "Software simulation in GSM environment of Federal standard 1016 CELP vocoder," Communication Technology Proceedings, 1998. ICCT '98. 1998 International Conference on , vol., No., pp. 5 pp. vol. 1, Oct. 22-24, 1998.*

Geiser et al. "Backwards Compatible Wideband Telephony in Mobile Networks: CELP Watermarking and Bandwidth Extension", 2007 IEEE International Conference on Acoustics, Speech, and Signal Processing, 2007, XP002460946, Apr. 15, 2007, pp. IV-533-IV-536.

Chétry, et al., "Embedding Side Information Into a Speech Codec Residual", European Signal Processing Conference, XP002460947, Sep. 4, 2006, 4 sheets, vol. E 88-D, No. 2.

Lu et al. ",Watermarking Combined with CELP Speech Coding for Authentication", IEICE Transactions on Information and Systems Inst. Electron. Inf. & Commun., XP0024600948, vol. E 88-D, No. 2, Feb. 2, 2005, pp. 330-334.

Iwakiri et al. "Embedding a text into conjugate structure algebraic code excited linear prediction audio codes", Computer System Symposium, Information Processing Society of Japan, Sep. 1, 1998, vol. 39, No. 9, pp. 2623-2630.

* cited by examiner

STEGANOGRAPHY IN DIGITAL SIGNAL ENCODERS

FIELD OF INVENTION

The invention is directed to a method for embedding steganographic information into signal information of a signal encoder.

BACKGROUND INFORMATION

Apart from analog sound, image and video transmissions, digital transmission is gaining more and more weight. Among other things, the reason for this is also that digital signal information is processed, i.e. copied or also compressed, in a simpler manner. Thus, the compression of digital signal information, in particular, leads to being able to transmit information with high information density by means of signal transmission channels having limited data transmission rates.

Apart from the compression of signal information as a type of processing, the embedding of "invisible"—steganographic—information into signal information has been successful in recent times. Such embedding of additional information makes it possible, for example, to identify copyrights—if the signal information is, for example, a piece of music—or generally speaking, providing general information of origin, that is to say a "digital watermark".

Even though such embedding of steganographic information in music and/or video signals has already been largely successful, embedding steganographic information into coded signal information is still associated with problems, particularly when it has to be transmitted in "real time". This is based on the fact that certain codings do not provide any redundancy and thus no room for steganographic information or that the steganographic information is lost during the decoding of the encoded signal information.

Such an initial situation in which signal information, mainly voice information in the given case, is transmitted and received via a channel and is encoded and decoded in real time and in which transmission resources are not available to an unlimited extent is found, for example, in mobile radio telephony. In this case, the GSM network allows a maximum transmission rate of 13.0 kbit/s, at best. Due to the very low transmission rate, uncoded voice information, i.e. uncompressed voice information in the present case, would scarcely be understandable any more on the receiver side. In order nevertheless to transmit comprehensible voice information, for example from one mobile radio device to another one, the so called voice codecs have become prominent as a tested means for compressed voice signal transmission. If additional information, i.e. steganographic information is to be embedded in such signal information, the special features resulting from the encoding must be taken into consideration.

In the field of mobile telecommunication, for example in GSM (Global System for Mobile Communications) mobile radio networks or UMTS (Universal Mobile Telecommunications Standard) mobile radio networks, the voice information to be transmitted is encoded by means of the familiar CELP (Code-book Excited Linear Predictive Coding) or ACELP (Algebraic Code Excited Linear Prediction) or in future the AMR (Adaptive Multi-Rate) coding. These voice coding methods are all based on a model of voice generation in which the formation of the voice signal is generated in an excitation stage and a filtering stage in a first approximation. A signal encoder such as, for example, a CELP encoder, an ACELP encoder or an AMR encoder, generates a code book entry, as a rule a vector from a so called code book, wherein the code elements of the code book entry—that is to say, as a rule, the vector components—contain information with respect to the (filter) excitation. Filter Coefficients, gain factors etc. are encoded as time information by means of dedicated code books.

As a rule, a code book for excitation coding consists of a set of vectors, for example having in each case 10 components in the case of ACELP coding according to the Enhanced Full Rate (EFR) Standard, which encode the voice information to be conveyed for a particular length, for example 5 milliseconds. From the dedicated code book which comprises a large multiplicity of vectors overall, the vectors being built up in accordance with familiar criteria, a subset of the code book, a sub-code book is used as a rule which is often sufficient for being able to transmit the normal voice information with good quality.

To distinguish it from the complete code book specified as part of the coding, the sub-code book used in practice is called a "practical code book".

To rapidly find a suitable code book entry, the practical code book is searched only heuristically, i.e. there is no complete search for a suitable code book entry.

A method which takes into consideration the splitting up of a fixed code book is disclosed in the article "Watermarking Combined with CELP Speech Coding for Authentication" by Zhe-Ming Lu et al. (in IEICE TRANS. INF. & SYST., Vol. E88-D, No. 2 Feb. 2005). In this method, a code book is first split up into three sub-code books from which, in turn, two code books are generated which have different characteristics. Depending on which steganographic information is to be conveyed, one code book entry is now selected from the sub-code book intended for this purpose and used for encoding the voice information to be conveyed. This voice information can be decoded on the receiver side where the actual decoder can also recognize at the same time from which splitting-up of the code book the code book entry originates. To provide a sufficiently good encoding from one of the sub-code books, the familiar analysis by synthesis method is also described in the application. In this method, the selected code word is evaluated, i.e. the quality of the encoding is checked. This is essentially done in that, after voice information has been encoded, the encoding is decoded, i.e. synthesized, and the result of the decoding which, in turn, represents voice information, is compared with the original voice information. Thus, a synthesis is carried out in advance at the transmitter side—encoder side—which, after a possible transmission, is also carried out on the receiver side—decoder side. Such an analysis by syntheses loop makes it possible to find a code word, i.e. as a rule a vector from a code book, which, on the one hand, has the desired characteristic, i.e. originating from the correspondingly split-up sub-code book, and at the same time encodes the voice information with adequate quality.

However, it is found that the fixed dividing of a practical code book—which, of course, is already a subset of a higher-level code book, in any case—into several sub-code books reduces the number of useable code words per sub-code book in such a manner that an audible reduction in voice quality is not impossible.

SUMMARY OF INVENTION

The present invention relates to embedding steganographic information into signal information of a signal encoder in such a manner that a reduction in voice quality is largely prevented.

In a method for embedding steganographic information into signal information of a signal encoder, the object is achieved, according to the invention, by providing data information, particularly voice information, selecting steganographic information from a set of steganographic information items, generating a code word from a provided code book by means of a signal encoder on the basis of code elements forming the code word, in such a manner that the data information is encoded, by using the generated code word within the scope of a transmission standard which can be associated with the code book, into signal information containing the code word and/or pointing to the code word; and that the code word generated has an additional characteristic which can be calculated on the basis of the code element forming the code word, the additional characteristic representing the steganographic information.

Such a method for embedding steganographic information into signal information of a signal encoder in which a code word is generated from a provided code book by means of the signal encoder on the basis of code elements forming the code word makes it possible to provide a code word which, on the one hand, has a calculable characteristic, i.e. represents steganographic information and, on the other hand, at the same time provides signal information which encodes for data information, particularly voice information. Due to the fact that the code book is not split up right from the start but, instead, a code book entry is generated on the basis of the code element forming the code word, code words can be taken into consideration which were not present in the practical code book and/or the split-up parts of the practical code book. This considerably extends the number of code elements which can be accessed so that either a splitting-up into more sub-code books in comparison with the prior art or, with the same number of sub-code books, an improved voice quality in comparison with the prior art can be provided.

In one embodiment of the invention, an evaluation of the generated code word is preferably carried out within the scope of a transmission standard which can be associated with the code book provided, by decoding the code word and subsequently comparing the decoded data information with the original data information.

This has the advantage that the quality of the generated code word can be evaluated with respect the coding/decoding fidelity, i.e. the loss of (voice) quality due to the coding and decoding.

Furthermore preferably, in an embodiment of the method according to the invention, the code word is generated from the provided code book by means of the signal encoder on the basis of the code elements forming the code word, taking into consideration the evaluation.

Taking into consideration the evaluation in the generation of the code word from the code book provided enables code words to be generated which have a high voice quality with respect to the information to be encoded.

In one embodiment of the invention, the use of an encoder and code book based on the GSM (Global System for Mobile Communications) and/or the UMTS (Universal Mobile Telecommunications Standard) transmission standard is provided.

This has the advantage that the method for embedding steganographic information can also be used in mobile radio networks.

For the further development of the invention, generating a code word on the basis of the CELP, ACELP (Algebraic Code Excited Linear Prediction) and/or AMR coding is provided.

The high distribution of the CELP or the ACELP coding enables the method according to the invention to be used in many areas of technology, particularly of mobile telecommunication. Pointing to the future, this analogously also applies to the AMR coding.

Furthermore, in one embodiment, the characteristic of the code word is calculated as the result of an application of at least one operation on at least one of the code elements forming the code word.

It is thus possible to determine on the basis of the code elements forming the code word, using at least one preferably mathematical operation, a characteristic of the code word which represents the steganographic information.

Furthermore, in an embodiment of the method according to the invention, the code word is provided in such a manner that the code word implicitly fulfills the characteristic.

This has the advantage that a code word can be generated in a such a manner that it already fulfills the characteristic represented by the steganographic information during its generation.

Furthermore, in one embodiment of the method according to the invention, the steganographic information is selected in such a manner that the steganographic information is used for improving the signal, particularly in the case of voice transmission, such as an artificial bandwidth extension and/or noise reduction.

It has been found that the additional transmittable steganographic information can be used in order to describe, for example, a characteristic of the data information actually to be transmitted so that the steganographic information can be used for improving the signal. This means that—if the code word encoding the data information is generated in accordance with the method according to the invention—the marginal loss in transmission quality is not only compensated by the additional steganographic information but can even be overcompensated.

Furthermore, in one embodiment, the steganographic information is selected in such a manner that the steganographic information is used as a digital watermark.

When the steganographic information is used as a digital watermark, it is possible to identify not only the originality and the origin of data information; instead, copyrights on data information can also be inserted in the form of a digital watermark with the aid of the steganographic information. In this context, the data information is scarcely impaired qualitatively within the scope of the method according to the invention.

In a further embodiment of the invention, the signal information containing the code word or pointing to the code word is transmitted to a receiver.

Transferring to a receiver advantageously makes it possible to transfer the data information and the steganographic information in the form of signal information over a spatial distance.

Furthermore, in one embodiment of the method according to the invention, data information is provided on the receiver side by decoding the code word within the scope of a transmission standard which can be associated with the code book provided.

Decoding the code word makes it possible to recover and use the data information, contained in the signal information, and the steganographic information.

Furthermore, preferably, in an embodiment of the method according to the invention, the steganographic information is provided on the receiver side by calculating the additional characteristic of the code word on the basis of the code elements forming the code word.

Depending on the arrangement of the receiver, it is possible to calculate the steganographic information which is contained in the signal information. This possibility can be used optionally, i.e. systems which are not capable of calculating the steganographic information in reverse will only extract the data information from the signal information without reaching the steganographic information.

Finally, in one embodiment of the invention, the method is also carried out in a mobile radio device.

The method is particularly suitable for transmitting signal information, i.e. voice or other information, by means of mobile radio devices which can be operated in a mobile radio network.

The aforementioned and claimed components to be used, which are described in the exemplary embodiments are not subject to any special exceptional conditions in their size, shape, arrangement, material selection and technical conceptions, and so the selection criteria known in the field of application can be applied without restriction.

Further details, features and advantages of the subject matter of the invention are found in the subclaims and in the subsequent description of the associated drawings in which—by way of example—a preferred exemplary embodiment of the invention is shown.

For the described encoding methods according to the exemplary embodiments of the invention, corresponding encoders are provided and corresponding methods for decoding and corresponding decoders.

DETAILED DESCRIPTION

Figure 1:
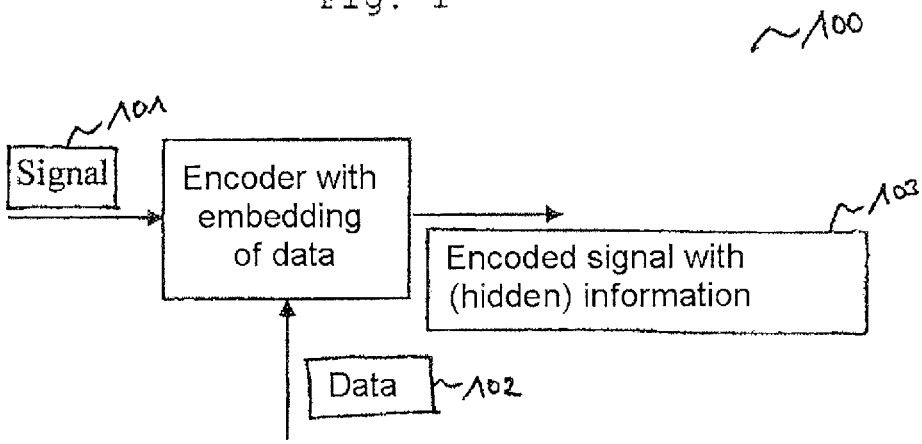
FIG. 1 shows an encoder 100 according to one exemplary embodiment of the invention.

FIG. 1 shows an encoder 100 according to one exemplary embodiment of the invention.

The encoder 100 is supplied with a signal 101 to be encoded, for example a voice signal 100. In addition, the encoder 100 is supplied with data 102 to be embedded. The encoder generates from the signal 101 to be encoded an encoded signal 103 into which the data 102 to be embedded are embedded, that is to say from which a corresponding decoder can determine the data 102 to be embedded.

The encoded signal 103 is conveyed, for example, to a receiver, for example by means of a computer network or by means of a radio network.

In the exemplary embodiment described in a text which follows it is assumed that the encoder 100 is used in a mobile radio network according to GSM (Global System for Mobile Communications). In other embodiments of the invention, the encoder can also be used as part of a mobile radio network according to UMTS (Universal Mobile Telecommunications Standard), CDMA2000 (Code Division Multiple Access) or according to FOMA (Freedom of Mobile Access).

In the exemplary embodiment described in the text which follows, it is assumed that the signal 101 to be encoded is a voice signal which is to be encoded by the encoder 100 in accordance with an ACELP (Algebraic Code Excited Linear Prediction) voice compression method, for example in accordance with an "Enhanced Full-Rate" ACELP voice compression method as is used in a GSM mobile radio network.

In one embodiment, the encoder 100 uses for embedding the information, that is to say for embedding the data 102 to be embedded in the encoded signal 103, for encoding the so called residual signal, a fixed (in other words stochastic) code book which is split into N sub-code books. For the actual encoding of the residual signal, the corresponding sub-code book is used depending on the information to be embedded, in accordance with a binning scheme.

Since the code book in a CELP voice encoder is not searched exhaustively (but only heuristically), the sub-code books can have an extent which is quite comparable with the searched part of the fixed code book and the quality of the CELP encoding suffers only little from the information embedding. Furthermore, the information embedding can be carried out with little algorithmic complexity.

In the exemplary embodiment described in the text which follows, the encoder 100 uses a code book which is defined as follows:

The code book C used in the present exemplary embodiment is the code book of the GSM EFR (Enhanced Full Rate) codec and is given by the vectors $\underline{c}$ of the ACELP pulse positions (without sign in the present exemplary embodiment) for each subframe of length 5 ms:

$$C=\{\underline{c}=(c_0, \ldots, c_9)\}$$

with $$c_0,c_5\in\{0,5,10,15,20,25,30,35\},c_1,c_6\in\{1,6,11,16,21,26,31,36\},$$

$$c_2,c_7\in\{2,7,12,17,22,27,32,37\},c_3,c_8\in\{3,8,13,18,23,28,33,38\}$$

where $$c_4,c_9\in\{4,9,14,19,24,29,34,39\}$$

A code word $\underline{c}$ from the code book (i.e. the set of all possible code words) C is thus a vector having ten components, each component describing a position of a pulse within a subframe. In the present exemplary embodiment, the code book C has an extent of 2^(10*log 2(8))=2^30 code words.

In another exemplary embodiment, the components of the vectors c have signs as intended according to EPR. Using components with signs provides for improved information embedding. In one embodiment, however, the use in EFR of components with signs is omitted for reasons of complexity.

In one embodiment, the code book C is split into two sub-code books C(1) and C(2) in such a manner that one bit of the data 101 to be embedded can be embedded into the encoded signal 102 per code word and correspondingly one bit of the data 101 to be embedded is conveyed per subframe which corresponds to a data rate of 200 bit/s with a subframe duration of 5 ms.

The code words of the sub-code books differ from one another in that the sum of the components $c_i$ of a code word is even-numbered from one sub-code book and odd-numbered from the other sub-code book. For example, all code words from C(1) meet the condition.

$$\sum_{i=0}^{9} c_i = 2\cdot trunc\left(\frac{1}{2}\sum_{i=0}^{9} c_i\right),$$

(i.e. the sum of the components is even-numbered) and all code words from C(2) meet the condition $$\sum_{i=0}^{9} c_i = 2 \cdot trunc\left(\frac{1}{2}\sum_{i=0}^{9} c_i\right) + 1$$

(i.e. the sum of the components is odd-numbered), where trunc designates the truncating operation, that is to say the truncating to the next smaller integral number.

If a first message (consisting of one bit in the present example, for example the bit value 0) is to be conveyed, a code word from C(1) is used for encoding (the current signal values of the signal 101 to be encoded) and if a second message (consisting of one bit in the present example, for example the bit value 1) is to be conveyed, a code word from C(1) is used for the encoding. A receiver or a decoder, respectively, can determine whether the first message or the second message has been embedded on the basis of the association of a received code word with C(1) or with C(2).

In another embodiment, C is subdivided in accordance with even and odd parity of the sum of the components of the code words. For example, a code word belongs to C(1) if $$\sum_{i=0}^{9} c_i$$

has an even number of ones in binary representation, and otherwise to C(2).

In one embodiment, four bits per subframe are embedded and thus a data rate of 400 bit/s is achieved. This is done by subdividing the code book C into four sub-code books C(1) to C(4), the code words of the sub-code books meeting, for example, the following conditions:

$$C(1):\ \sum_{i=0}^{4} c_{2i} = 2 \cdot trunc\left(\frac{1}{2}\sum_{i=0}^{4} c_{2i}\right),$$

$$C(2):\ \sum_{i=0}^{4} c_{2i+1} = 2 \cdot trunc\left(\frac{1}{2}\sum_{i=0}^{4} c_{2i+1}\right)$$

$$C(3):\ \sum_{i=0}^{4} c_{2i} = 2 \cdot trunc\left(\frac{1}{2}\sum_{i=0}^{4} c_{2i}\right) + 1$$

$$C(4):\ \sum_{i=0}^{4} c_{2i+1} = 2 \cdot trunc\left(\frac{1}{2}\sum_{i=0}^{4} c_{2i+1}\right) + 1.$$

To illustrate, the distinction is made here on the basis of the parity or imparity of the sum of the components with even-numbered or odd-numbered index, respectively.

Analogously to the above alternative, the subdivision of the code book C into four sub-code books can be carried out on the basis of the parity of a binary representation of the sum of components with even-numbered or odd-numbered index, respectively, and that is to say on the basis of the parity of $$\sum_{i=0}^{4} c_{2i} \text{ or } \sum_{i=0}^{4} c_{2i+1},$$

respectively.

In the above conditions for the code books C(1) and C(2) or C(1) to C(4), respectively, instead of a component $c_i$ itself, the expression trunc($c_i$/5) can also be used as an alternative which unambiguously designates a pulse position within a so-called track. As an alternative, the respective Gray-encoded version or GRAY($c_i$) or GRAY(trunc($c_i$/5)) can also be used which is provided for channel encoding with EFR. Taking into consideration the actual transmission of code words via a GSM mobile radio channel, this possibility for splitting up the code book is found to be particularly advantageous. It has the result that particularly few channel bits have an influence on the embedded data as a result of which the bit error rate of the transmitted embedded data drops when the transmission is disturbed.

Generally, in one embodiment, the code book C can be split up in such a manner that the code words of the sub-code book which is used for the encoding if a message bit $m_i$ is to be transmitted meet the condition $$m_i = \bigoplus_{j \in A_i} b_j$$

where $A_i$ designates an index set, $b_j$ designates the components of the respective code word. The summation is carried out modulo 2 in this arrangement so that it is required that the sum modulo 2 of several code word bits $b_j$ is equal to the message bit $m_i$ to be embedded.

Reconstructing an embedded message in a received code word or one to be decoded only requires that the decoder determines the sub-code book to which the code word belongs. If the code words are transmitted undisturbed to the decoder, the embedded information can also be reconstructed without errors.

The procedure for embedding information, described above, can also be used with other encoders, for example with all CELP voice encoders but also with other signal encoders such as video encoders, image encoders etc.

The transmission of page information (embedded information) by means of steganography can also be used for improving the signal and represents a solution for the problem of backward compatibility. A receiver without knowledge of the embedded information can decode the (voice) signal into which the information has been embedded, as usual, that is to say as in the case of no embedding of information, with only slight losses. If, in contrast, the receiver knows the embedded information, the page information can be used for improving the signal. A corresponding exemplary embodiment will be described with reference to FIG. 2 in the text which follows.

Figure 2:
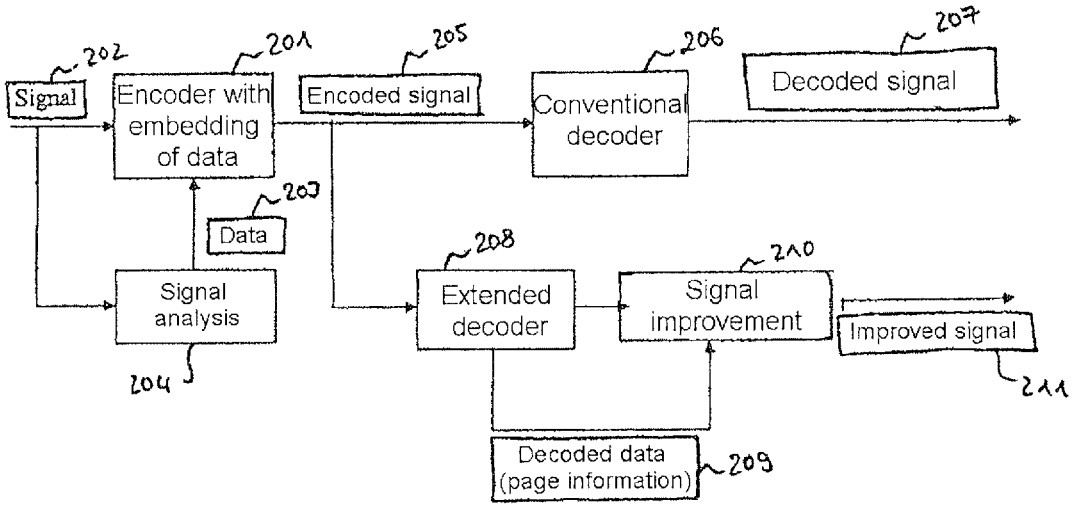
FIG. 2 shows an encoder/decoder system 200 according to one exemplary embodiment of the invention.

FIG. 2 shows an encoding/decoding system 200 according to a further exemplary embodiment of the invention.

The encoding/decoding system 200 has an encoder 201 as described with respect to FIG. 1. Correspondingly, the coder 201 is supplied with a signal 202 to be encoded and data 203 to be embedded. The data to be embedded are used for improving the signal and are correspondingly generated by a signal analysis device 204 which is supplied with the signal 202 to be encoded, in a manner suitable for improving the signal 202 to be encoded.

Analogously to FIG. 1, the encoder 201 outputs an encoded signal 205 into which the data 203 to be embedded are embedded. The encoded signal 205 can then be conveyed to a receiver, for example by means of a mobile radio communication network, as described above.

If the receiver has a "conventional" decoder 206, that is to say a decoder which cannot determine the embedded data from the encoded signal 205, the decoder 206 only decodes the encoded signal 205 to form a decoded signal 207 which corresponds to the signal 202 to be encoded (apart from transmission errors and encoder/decoder losses).

If the receiver has an "extended" decoder 208, that is to say a decoder which can determine the embedded data from the encoded signal 205, the embedded data are extracted and the extracted data 209 are used for signal improvement by a signal improving unit 210 which generates a decoded and improved signal 211 (compared with the decoded signal 207).

The signal improvement used can be e.g. artificial bandwidth extension or noise reduction. The coefficients of a post-filter determined on the transmitter side can also be transmitted by steganography.

The application of artificial bandwidth extension, in particular, is advantageous since the telephone network is historically limited to an acoustic bandwidth of 3.1 kHz (300 Hz-3.4 kHz), but a transmission of broadband voice (50 Hz-7 kHz) could only be managed with enormous expenditure by the network operators and the terminal manufacturers. In contrast, implementation of the embodiments described above does not require any changes in the (mobile radio) transmission network. Corresponding (efficient) bandwidth extension algorithms are described, for example, in the publication by Peter Jax, Bernd Geiser, Stefan Schandl, Hervé Taddei and Peter Vary, "An Embedded Scalable Wideband Codec Based on the GSM EFR Codec", in Proceedings of ICASSP, Toulouse, May 2006. Furthermore, the introduction of wideband voice transmission by the detour of bandwidth extension (possibly with support by digital watermarks) is mentioned in the publication by Peter Jax and Peter Vary, "Bandwidth Extension of Speech Signals: A Catalyst for the Introduction of Wideband Speech Coding?", IEEE Communications Magazine, vol. 44, no. 5, May 2006.

In the text which follows, a further possibility for splitting up the code book C (EFR ACELP code book) defined above is described.

To provide a better understanding, the search strategy of the EFR codec will first be explained briefly:

1) Firstly, the first pulse position $i_0 \in \{0, \ldots, 39\}$ is determined heuristically and remains fixed during the entire search. The track belonging to $i_0$ is, for example, x=4 or x=9. For the x-th component $c_x$ of the corresponding code word, $c_x=i_0$ applies.

2) The position of the second pulse $i_1 \in \{0, \ldots, 39\}$ is also determined heuristically, a different value being assumed for each of the four iterations of the algorithm below (step 3). For example, let track y=3 or y=8 belong to the selected position $i_1$ for the first iteration, i.e. $c_y=i_1$.

3) For the remaining eight tracks, the pulses are progressively optimized by exhaustive search in pairs of two tracks each for each of four iterations. In each of the four iterations, the track pairs are reassembled by permutation, where $c_x$ and $c_y$ are not reused.

For example, for the track pair $c_0/c_6$, the optimization is carried out in accordance with the following pseudocode:

```
for (i = 0,5,10, . . . ,35) // iteration over all permissible
                              elements for c0
  for (j = 1,6,11, . . . ,36) // iteration over all permissible
                              elements for c6
    test pulse pair (c0=i, c6=j) for optimality in accordance
    with the CELP criterion.
```

-continued

With this search strategy according to EFR, a total of 1024 combinations (4 iterations*4 track pairs*8 pulse positions*8 pulse positions=1024 combinations) are examined and from these the optimum pulse pairs are selected.

To embed information, in the following example of a single (watermark) bit b, into a code word $c=(c_0, \ldots, c_9)$, the above algorithm, according to an exemplary embodiment of the invention, is modified as described in the text which follows.

If during a search a pulse has already been determined for a track, for example $c_1$, $c_6$ can be embedded into the pulse position pair $c_1$ and $c_6$ by a watermark bit b during the selection of the (identically configured) track in that $c_6$ is selected in dependence on bit b. For this purpose, the pair-by-pair search is modified, for example, as follows:

```
c6_offset = 5 * ((c1 + b + 1) mod 2)
for (i = 0,5,10, . . . ,35)  // iteration over all permissible elements
                                for c0
  for (j = 1,11,21,31)  // iteration over all permissible
                          elements for c6 (compared with half the
                          number above)
    test pulse pair (c0=i, c6=j+c6_offset) for optimality in
                    accordance with the CELP criterion.
```

The embedded bit b can be determined in the receiver or decoder by the operation $$b=(c_1+c_6)\bmod 2.$$

Instead of $c_6$_offset=5*((c1+b+1)mode 2), other combinations of previously determined pulse positions and bits to be embedded can also be used. In the above example, the search space for the pulse position $c_6$ was divided into two equal parts (odd/even values). Further divisions (for instance first/second value half) are also possible, the equation of $c_6$_offset having to be adapted correspondingly.

Due to the bit embedded in this manner, the number of pulse position combinations examined has dropped to 4 iterations*(3 pairs*8 positions*8 positions+1 pair*8 positions*4 positions)=896 combinations.

To embed several bits in one code word c the search space for $c_6$ can be halved again or an identical method can be used for a second pulse pair. It is advantageous to couple especially those pulses which are located in one track by $c_6$_offset (or bit b), respectively) during the embedding of information. Otherwise, it is no longer possible to perform an unambiguous allocation of the pulses in the receiver due to the sign encoding of the EFR. This restriction can be canceled by a corresponding additional expenditure in the transmitter. In the receiver, $c_1$ and $c_6$ cannot be distinguished from one another. The data extraction via $b=(c_1+c_6)\bmod 2$ does not present any problems, therefore, but it is difficult to calculate, for example, $b=(c_1+c_5)\bmod 2$ since (depending on the sign) $b=(c_6+c_5)\bmod 2$ could be "accidently" calculated. The "additional expenditure" at the transmitter end consists in taking into consideration the sign encoding in the optimization loops and virtually anticipating it for each optimization step.

Due to the reduced number of combinations examined (896 instead of 1024 in the above example), a lower encoding quality by watermark embedding is obtained. This can be compensated for by an extended search, that is to say an extension of the search space. For this purpose, the tracks are no longer searched jointly in pairs but in groups of 3 or 4 (or even more) tracks. The joint search (without watermark embedding) for 3 tracks (e.g. $c_0$, $c_6$ and $c_7$) is implemented, for example, as follows:

```
for (i2 = 0,5,10, . . . ,35)   // iteration over all permissible values
                                  for c0
  for (i3 = 1,6,11, . . . ,36)   //   iteration over the permissible
                                     values for c6
    for (i4 = 2,7,12, . . . ,37)   // iteration over the permissible
                                       values for c7
    search optimum triple (c0=i2, c6=i3, c7=i4)
```

For each triple, this means that 8*8*8=512 combinations are searched. If the entire search for the 8 variable pulse positions (according to steps 1 and 2, two pulse positions are fixed, of course) is divided in such a manner that 2 triples and 1 pair are optimized jointly, the result is that 4 iterations*(2 triples*8 positions*8 positions*8 positions+1 pair*8 positions*8 positions)=4352 combinations are examined which means a considerable additional expenditure compared with the 1024 combinations according to EFR.

If, however, e.g., 3 watermark bits are embedded during the optimization of the first triple and 2 watermark bits are embedded during the optimization of the second triple, as described above, whilst there is no embedding for the pulse position pair, the resultant number of combinations to be examined is now 4 iterations*(1 triple*4 positions*4 positions*4 positions+1 triple*8 positions*4 positions*4 positions+1 pair*8 positions*8 positions)=1024 combinations, i.e. exactly the number of combinations examined in the standard EFR codec. In this case, the watermark data rate is (2+3)bits/5 ms=1 kbit/s.

Finally, a further possibility for extending the search space is increasing the number of iterations, i.e. the examination of further track permutations.

The concept forming the basis of one exemplary embodiment can be seen in that the embedding of information is known to the signal encoder which is achieved by joint data embedding and signal encoding, that is to say, for example, the watermark embedding is integrated in the encoder. This can be carried out within an analysis-by-synthesis loop ("closed loop") as shown in FIG. 3.

Figure 3:
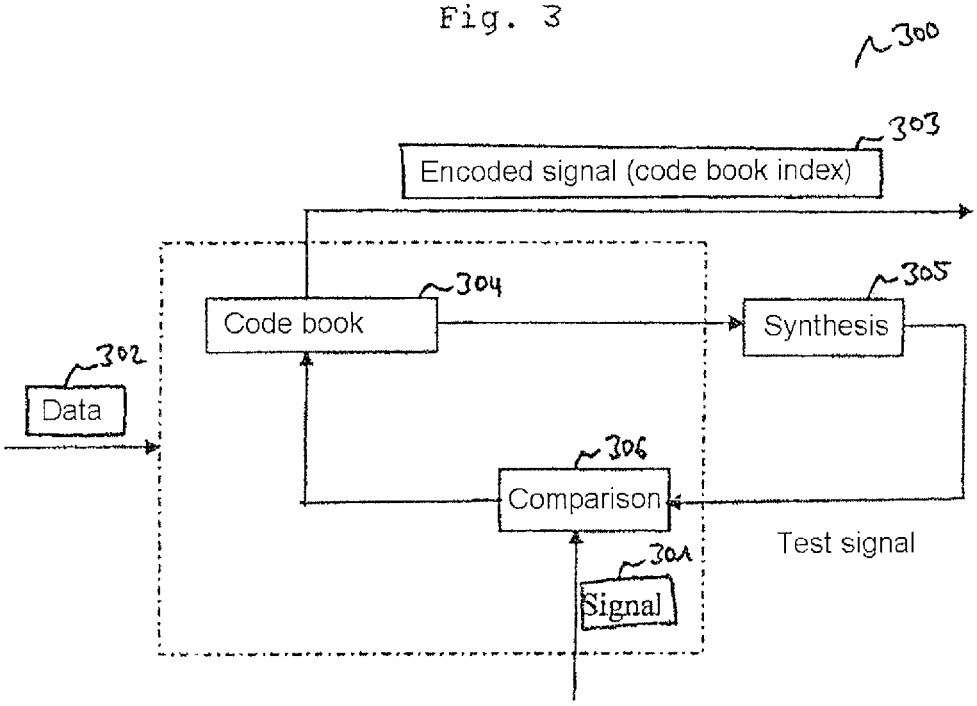
FIG. 3 shows an encoder 300 according to one exemplary embodiment of the invention.

FIG. 3 shows an encoder 300 according to a further exemplary embodiment of the invention.

The encoder is supplied with a signal to be encoded and data 302 to be embedded.

From the signal 301 to be encoded, an encoded signal 303 is generated by means of a loop which has a code book 304, a synthesis device 305 and a comparator 306. In this arrangement, a possible encoding of the signal 301 to be encoded is generated from the code book 304 and by means of the synthesis device 305 and the comparator 306 a check is made as to how well it reflects the signal 301 to be encoded and, if necessary, it has changed on the basis of the output of the comparator 306.

The data 302 to be embedded are embedded into the encoded signal 303 in the course of the encoding process, for example in accordance with one of the procedures described above.

Figure 4:
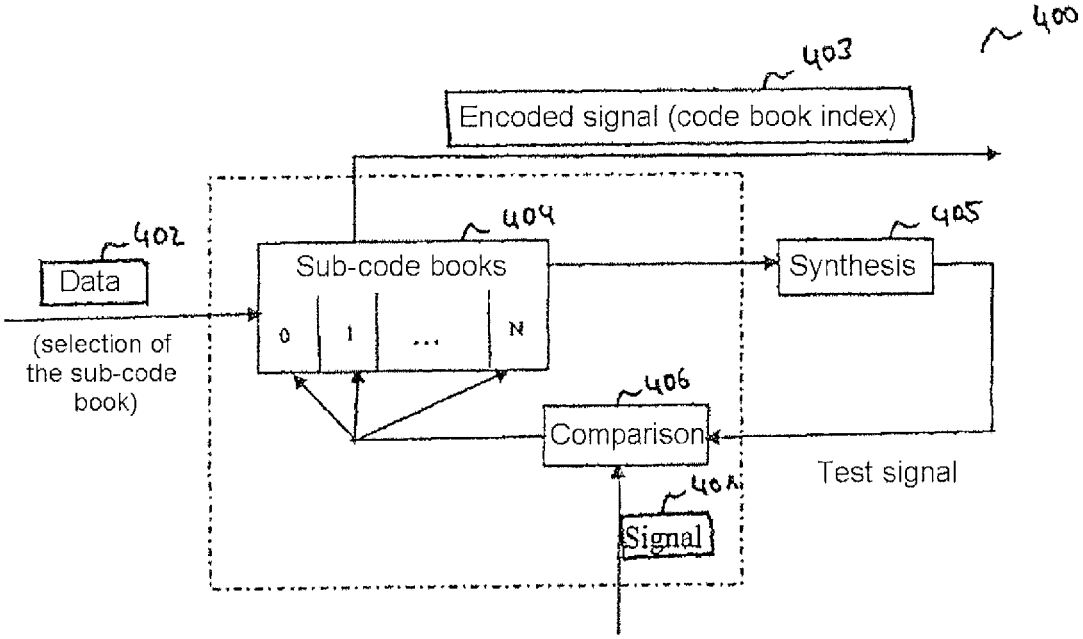
FIG. 4 shows an encoder 400 according to one exemplary embodiment of the invention.

For example, a sub-code book of the code book 304 is selected on the basis of the data 302 to be embedded, as is shown in FIG. 4.

FIG. 4 shows an encoder 400 in accordance with a further exemplary embodiment of the invention.

Analogously to the encoder 300 shown in FIG. 3, the encoder is supplied with data 402 to be embedded and a signal 401 to be encoded and it generates an encoded signal 403 in which the data 402 to be embedded are embedded. Apart from a synthesis device 405 and a comparator 406 analogously to the encoder 300 in FIG. 3, the encoder 400 has a multiplicity of sub-code books 404, that is to say a code book subdivided into several sub-code books 404. The sub-code books are selected on the basis of the data to be embedded during the encoding of the signal 401 to be encoded. For example, a code word from a first sub-code book is allocated to a data word of the signal 401 to be encoded, if a first page information from the data 402 to be embedded, for example a bit having the value 0, is to be embedded and a code word from a second sub-code book is allocated if a second page information from the data 402 to be embedded, for example a bit having the value 1, is to be embedded.

Figure 5:
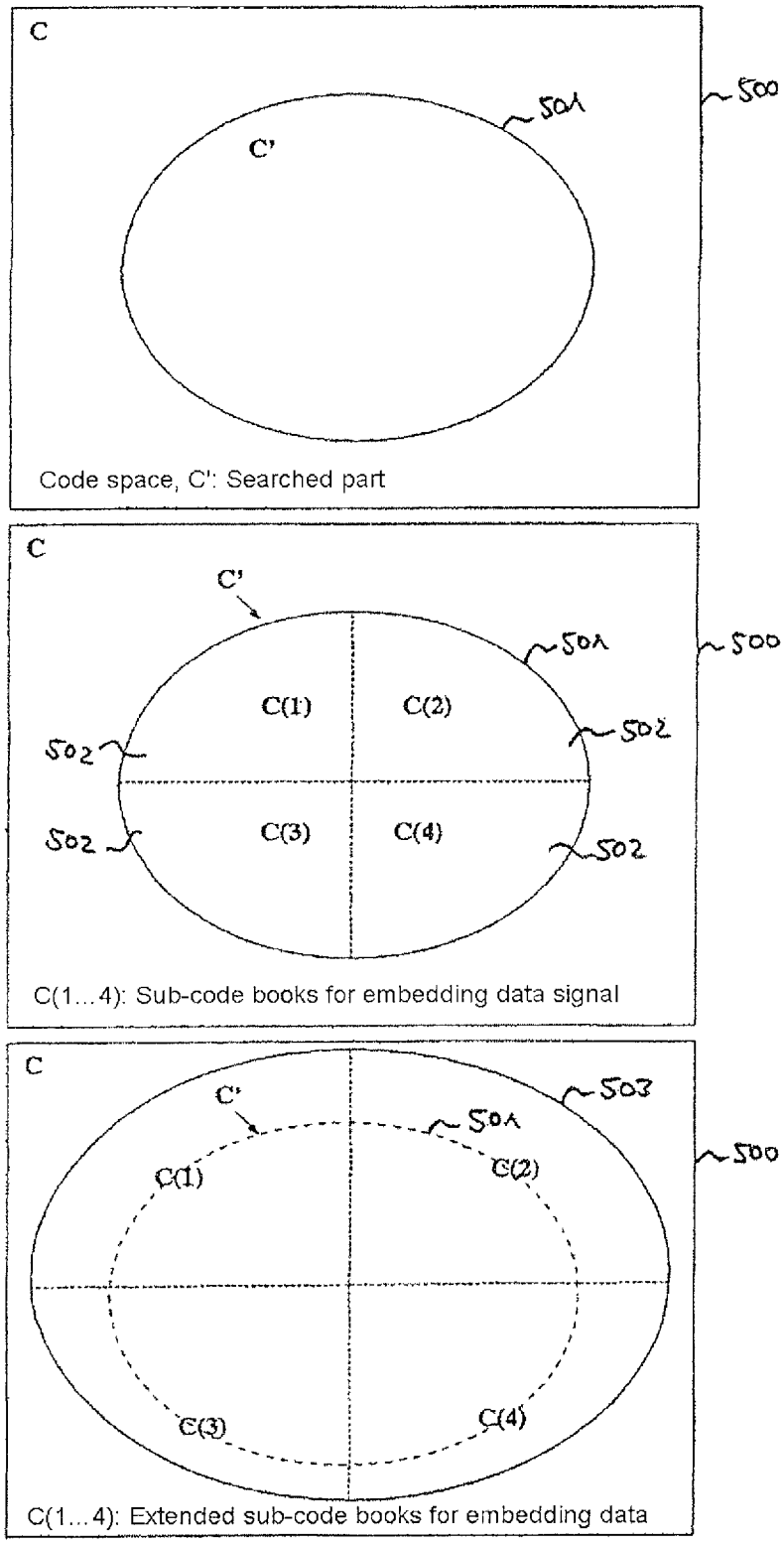
FIG. 5 shows a code book 500 according to one exemplary embodiment of the invention.

The division of a code book into several sub-code books is illustrated in FIG. 5.

FIG. 5 shows a code book 500 according to a further exemplary embodiment of the invention.

The code book 500 is designated by C. For reasons of efficiency, the code book 500 is searched only partially during the encoding if the volume of code words of the code book 500 is very large, i.e. code words are selected for encoding only from a code book subset 501 which is designated by C' (practical code book).

In the above exemplary embodiments, the code book 500, for the purpose of embedding data, is split into code books as explained above, for example into four sub-code books 502 which are designated by C(1) to C(4).

Since a sub-code book 502 has a lesser volume of code words than the code book subset 501 and thus the quality of the signal encoding would drop (depending on the number of sub-code books 502) compared with a use of the entire code book subset 501, the code volume of the sub-code books 502 is extended in one exemplary embodiment so that an extended code book subset 503 is used overall for encoding. In this arrangement, the algorithmic complexity increases only slightly, the quality of the encoding does not drop and it is even possible to achieve an increase in quality in special cases.

In one embodiment, an algebraic code book is used. In contrast to a normal code book in table form, an algebraic code book only exists in the sense of an algebraic construction rule. This means that the individual code book entries (code words) are generated by a code word generator in the course of the signal encoding. The "binning scheme" for embedding information, that is to say the splitting up of the code book into sub-code books and selection of the sub-code book used for the encoding in dependence on the information to be embedded, in the case of an encoder with algebraic code book, now no longer consist only in dividing the code book into a number of sub-code books but in addition also in modifying the code word generator to the extent that in each case only code words belonging to the sub-code book C(i) selected by the message i currently to be embedded are output.

The invention claimed is:

1. A method for embedding steganographic information into signal information of a signal encoder, comprising:

providing data information, in particular voice information, as a signal to be coded;

selecting steganographic information as data to be embedded, wherein said steganographic information is selected from a set of steganographic information items; and generating a code word from a provided algebraic code book using the signal encoder as a function of an algebraic construction rule based on the code elements forming the code word, so that:

(a) the data information is encoded, by using the generated code word within the scope of a transmission standard which can be associated with the code book, into signal information containing the code word or pointing to the code word, in the form of an encoded signal;

(b) the generated code word has an additional characteristic which can be calculated as a function of the code elements forming the code word, the additional characteristic representing the steganographic information; and (c) the code book is sub-divided as a function of the algebraic construction rule into a set of sub-code books, and in each case only one code word associated with the sub-code book selected by the steganographic information to be current embedded is output by the signal encoder.

2. The method of claim 1, further comprising evaluating the generated code word within the scope of the transmission standard which is associated with the code book by decoding the code word and subsequently comparing the decoded data information with the original data information.

3. The method of claim 2, wherein the generating step takes into consideration a result of the evaluating step.

4. The method of claim 1, wherein the encoder and code book are based on at least one of the GSM transmission standard and the UMTS transmission standard.

5. The method of claim 1, wherein the generating step includes generating a code word as a function of one of the CELP coding, the ACELP coding, and the AMR coding.

6. The method of claim 1, wherein the characteristic of the code word is calculated as the result of an application of at least one operation on at least one of the code elements forming the code word.

7. The method of claim 1, wherein the code word implicitly fulfills the characteristic.

8. The method of claim 1, wherein the step of selecting steganographic information includes selecting the steganographic information so that the steganographic information is used for improving the signal on the receiver side.

9. The method of claim 1, wherein the step of selecting steganographic information includes selecting the steganographic information so that the steganographic information is used for at least one of an artificial bandwidth extension and a noise reduction on the receiver side.

10. The method of claim 1, wherein the step of selecting steganographic information includes selecting the steganographic information so that the steganographic information is used as a digital watermark.

11. The method of claim 1, further comprising transmitting the signal information either containing the code word or pointing to the code word for a receiver.

12. The method as claimed in claim 1, further comprising providing data information on the receiver side by decoding the code word within the scope of the transmission standard.

13. The method of claim 11, further comprising providing the steganographic information on the receiver side by calculating the additional characteristic of the code word as a function of the code elements forming the code word.

14. The method of claim 1, wherein the method is utilized in a mobile radio device.

15. A signal encoder for embedding steganographic information into signal information of the signal encoder (100), characterized by a first device for receiving data information, in particular voice information, as a signal to be encoded;

a second device for receiving steganographic information as data to be embedded, wherein the steganographic information is selected from a set of steganographic information items;

a third device for generating a code word from a provided algebraic code book using the signal encoder as a function of an algebraic construction rule based on the code elements forming the code word, so that:

(a) by using the generated code word within the scope of a transmission standard which can be associated with the code book, the data information is encoded into signal information containing the code word or pointing to the code word, in the form of an encoded signal; that (b) the generated code word has an additional characteristic which can be calculated as a function of the code elements forming the code word, the additional characteristic representing the steganographic information; and (c) the code book is sub-divided as a function of said algebraic construction rule into a set of sub-code books, and in each case only one code word associated with the sub-code book selected by the steganographic information to be currently embedded is output by the signal encoder.

16. The signal encoder of claim 15, configured to provide the code word such that the code word implicitly fulfils the characteristic.

17. The signal encoder of claim 15, wherein the third device is configured to generate the code word such that the code word already fulfils the characteristic which the steganographic information represents while it is being generated.

18. The signal encoder of claim 15, configured to determine a first code element and a second code element of the code word, wherein the signal encoder determines the second code element as a function of the first code element and the information to be embedded.

* * * * *

UNITED STATES PATENT AND TRADEMARK OFFICE

CERTIFICATE OF CORRECTION

PATENT NO. : 8,412,519 B2
APPLICATION NO. : 12/441209
DATED : April 2, 2013
INVENTOR(S) : Geiser et al.

It is certified that error appears in the above-identified patent and that said Letters Patent is hereby corrected as shown below:

In the Specification

In Column 6, Line 44, delete " 2^(10*log 2(8))" and insert -- 2^(10*log_2(8))--, therefor.

In Column 6, Line 46, delete " C" and insert -- $\frac{C}{}$--, therefor.

In Column 7, Lines 47-49, delete " $2 \cdot trunc\left(\frac{1}{2}\sum_{i=0}^{4} c_{2i+1}\right)$" and insert -- $2 \cdot trunc\left(\frac{1}{2}\sum_{i=0}^{4} c_{2i+1}\right)$, --, therefor.

In Column 7, Lines 51-53, delete " $2 \cdot trunc\left(\frac{1}{2}\sum_{i=0}^{4} c_{2i}\right) + 1$" and insert -- $2 \cdot trunc\left(\frac{1}{2}\sum_{i=0}^{4} c_{2i}\right) + 1$, --, therefor.

In the Claims

In Column 14, Line 18, in Claim 15, delete "signal encoder (100)," and insert -- signal encoder, --, therefor.

In Column 14, Line 19, in Claim 15, delete "by" and insert -- by: --, therefor.

Signed and Sealed this
Sixteenth Day of July, 2013

Teresa Stanek Rea
*Acting Director of the United States Patent and Trademark Office*